US011136222B2

(12) United States Patent
Bruno

(10) Patent No.: US 11,136,222 B2
(45) Date of Patent: Oct. 5, 2021

(54) ELEVATOR CAR APRON

(71) Applicant: Otis Elevator Company, Farmington, CT (US)

(72) Inventor: Gilles Bruno, Chateauneuf sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 177 days.

(21) Appl. No.: 16/510,015

(22) Filed: Jul. 12, 2019

(65) Prior Publication Data

US 2020/0031629 A1 Jan. 30, 2020

(30) Foreign Application Priority Data

Jul. 26, 2018 (EP) ..... 18306011

(51) Int. Cl.

| | |
|---|---|
| ***B66B 13/28*** | (2006.01) |
| ***B66B 9/00*** | (2006.01) |
| ***B66B 11/00*** | (2006.01) |
| ***B66B 11/02*** | (2006.01) |

(52) U.S. Cl.

CPC ..... *B66B 13/285* (2013.01); *B66B 9/00* (2013.01); *B66B 11/0005* (2013.01); *B66B 11/0226* (2013.01)

(58) Field of Classification Search

CPC ..... B66B 13/285; B66B 13/28; B66B 17/18

See application file for complete search history.

(56) References Cited

U.S. PATENT DOCUMENTS

| | | | | |
|---|---|---|---|---|
| 4,556,129 | A | 12/1985 | Martin | |
| 2009/0114486 | A1* | 5/2009 | Ikonen | B66B 13/301 187/400 |
| 2014/0020986 | A1* | 1/2014 | Delachatre | B66B 13/285 187/400 |

(Continued)

FOREIGN PATENT DOCUMENTS

| | | | |
|---|---|---|---|
| CN | 1982195 | A | 6/2007 |
| CN | 201058781 | Y | 5/2008 |

(Continued)

OTHER PUBLICATIONS

Espacenet English Translation of Description, Crash Protection for Elevator Installations, Nov. 16, 2011, DE 202011051638 U1 (Year: 2011).*

(Continued)

*Primary Examiner* — Michael R Mansen
*Assistant Examiner* — Michelle M Lantrip
(74) *Attorney, Agent, or Firm* — Cantor Colburn LLP

(57) ABSTRACT

Elevator systems are provided. The systems include an elevator car movable along an elevator shaft, the shaft having a pit floor and a shaft top, the elevator car having an elevator car door sill. A plurality of landings are arranged along the elevator shaft, wherein each landing has a landing door. A car apron assembly is provided that includes a car apron attached to the elevator car at the elevator car door sill, a first triggering element connected to at least one landing door, and a second triggering element operably connected to the car apron. The car apron is deployable from a stowed state to a deployed state when the first triggering element engages and actuates the second triggering element.

17 Claims, 4 Drawing Sheets

(56) References Cited

U.S. PATENT DOCUMENTS

2014/0216860 A1* 8/2014 Karimpanackal Natarajan ..... B66B 13/285 187/400

FOREIGN PATENT DOCUMENTS

| | | | | | |
|---|---|---|---|---|---|
| CN | 103889875 | A | | 6/2014 | |
| CN | 108059063 | A | | 5/2018 | |
| CN | 207375550 | U | | 5/2018 | |
| DE | 20105638 | U1 | | 8/2001 | |
| DE | 10052459 | A1 | | 5/2002 | |
| DE | 102006034716 | B3 | * | 9/2007 | B66B 13/285 |
| DE | 202006007666 | U1 | | 10/2007 | |
| DE | 102008038408 | A1 | * | 3/2009 | B66B 13/285 |
| DE | 202011051638 | U1 | * | 11/2011 | B66B 5/0081 |
| EP | 1215159 | A2 | | 6/2002 | |
| EP | 1524234 | A1 | | 4/2005 | |
| EP | 1753689 | B1 | | 2/2007 | |
| EP | 1772414 | A1 | | 4/2007 | |
| EP | 1914190 | A1 | | 4/2008 | |
| EP | 2138443 | A1 | * | 12/2009 | B66B 13/285 |
| EP | 2094597 | B1 | | 1/2015 | |
| EP | 2782861 | B1 | | 7/2017 | |
| EP | 3257803 | A | | 12/2017 | |
| JP | S5347650 | A | | 4/1978 | |
| JP | 2002302370 | A | | 10/2002 | |
| JP | 2005145610 | A | | 6/2005 | |
| WO | 02060802 | A2 | | 8/2002 | |
| WO | 2013054321 | A1 | | 4/2013 | |

OTHER PUBLICATIONS

European Search Report for European Application No. 18306011.0, International Filing Date Jul. 26, 2018, dated Jan. 24, 2019, 7 pages.

* cited by examiner

ELEVATOR CAR APRON

CROSS REFERENCE TO RELATED APPLICATIONS

This application claims the benefit of European Application No. 18306011.0, filed Jul. 26, 2018, which is incorporated herein by reference in its entirety.

BACKGROUND

The subject matter disclosed herein generally relates to elevator systems and, more particularly, to elevator car aprons and safety mechanisms for elevator systems.

Traditional safety requirements for elevator shafts have led to larger spaces both at the top and bottom of the elevator shaft. However, such enlarged spaces may be disadvantageous for architectural reasons. Thus, elevator lift manufacturers have attempted to reduce hoistway or elevator shaft overhead dimensions and pit depth while maintaining safety features. Mechanics currently go to the top of car, or on top thereof, or in the pit, for inspection or maintenance activity of various components of an elevator car system. Thus, safety spaces or volumes are employed within the elevator shaft to protect a mechanic in the event of an emergency and thus require increased overhead and pit dimensions.

Further advancements and designs have attempted to completely eliminate the need for a mechanic to enter the hoistway, thus improving safety. An advantage of eliminating the need for entering the hoistway is that the traditional large pit depths and/or overhead spaces may be reduced such that very small pit depths/overhead clearances may be employed in such elevator systems.

Elevator cars typically include a toe guard or car apron situated beneath the elevator car door. The car apron is arranged to prevent persons from falling into an elevator shaft if the elevator car is not located at a landing and the landing doors are opened. The car apron is typically rigid and has a nominal height of about 750 mm. A significant amount of clearance beneath the elevator car is required to avoid contact between the car apron and the bottom of the elevator shaft when the elevator car is situated at a lowest landing. Such contact could cause significant damage to the car apron due to the rigid and fixed nature of the car apron. Accordingly, retractable car aprons have been proposed to address the above issues for systems employing small pit depths. However, improved systems may be advantageous.

BRIEF SUMMARY

According to some embodiments, elevator systems are provided. The elevator systems include an elevator car movable along an elevator shaft, the shaft having a pit floor and a shaft top, the elevator car having an elevator car door sill, a plurality of landings arranged along the elevator shaft, wherein each landing has a landing door, and a car apron assembly. The car apron assembly includes a car apron attached to the elevator car at the elevator car door sill, a first triggering element connected to at least one landing door, and a second triggering element operably connected to the car apron. The car apron is deployable from a stowed state to a deployed state when the first triggering element engages and actuates the second triggering element.

In addition to one or more of the features described above, or as an alternative, further embodiments may include that the first triggering element has as first height and the landing door has a second height, wherein the first height is less than the second height.

In addition to one or more of the features described above, or as an alternative, further embodiments may include that the first triggering does not extend to a bottom of the landing door.

In addition to one or more of the features described above, or as an alternative, further embodiments may include that the car apron comprises an apron housing attached to the elevator car door sill and a retractable apron device contained within the apron housing, wherein the retractable apron device is deployable to a deployed state upon actuation of the second triggering element.

In addition to one or more of the features described above, or as an alternative, further embodiments may include that the second triggering element comprises an actuation arm and a lock pin, wherein the lock pin secures the car apron in the stowed state and actuation of the actuation arm unlocks the lock pin to deploy the car apron to the deployed state.

In addition to one or more of the features described above, or as an alternative, further embodiments may include a pivot arrange to operably connect the actuation arm to the lock pin.

In addition to one or more of the features described above, or as an alternative, further embodiments may include that the second triggering element is spring loaded to reset after deployment of the car apron.

In addition to one or more of the features described above, or as an alternative, further embodiments may include that each landing door includes a respective first triggering element.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited by the accompanying figures in which like reference numerals indicate similar elements.

DETAILED DESCRIPTION

Figure 1:
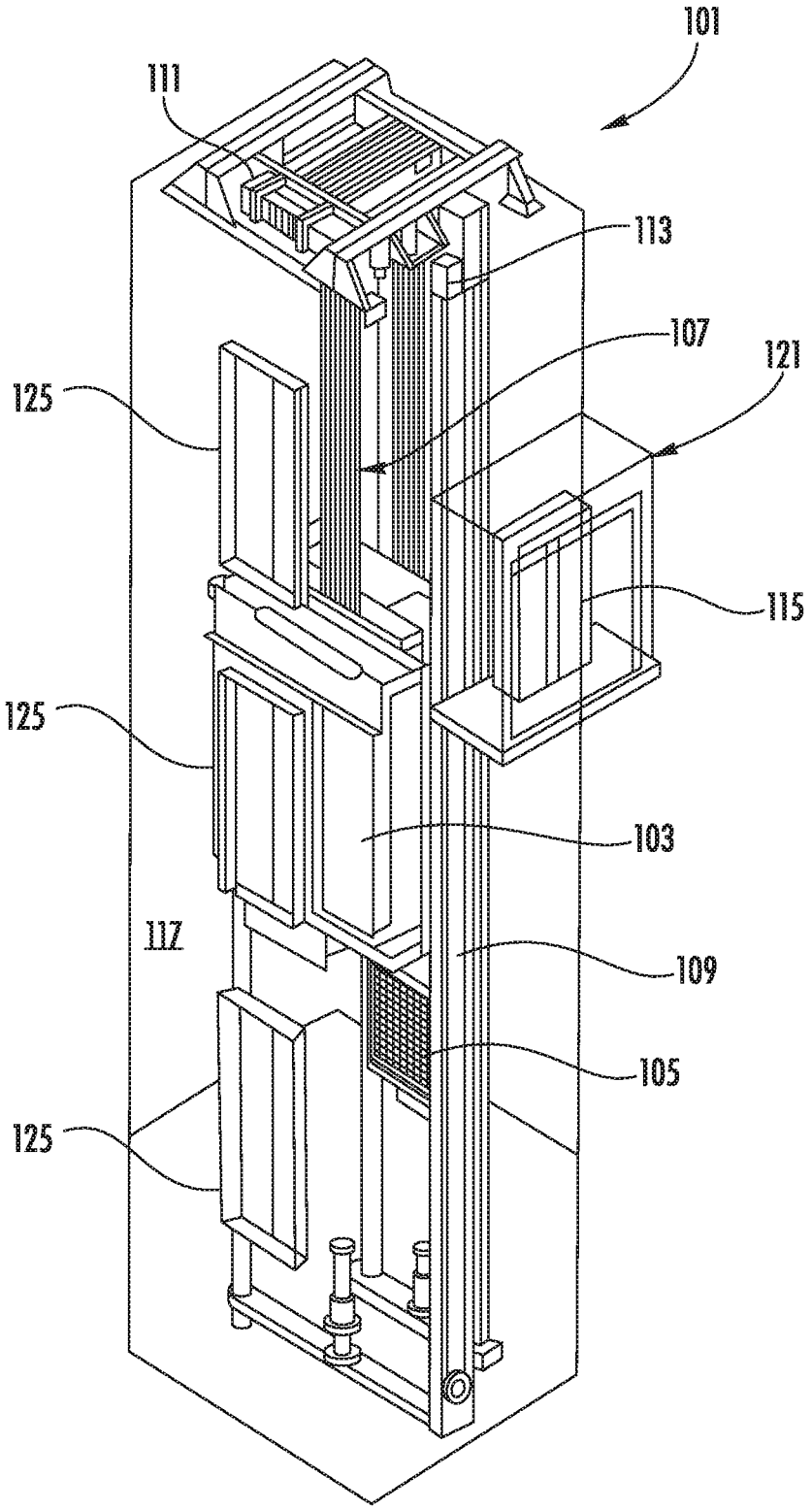
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter-weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
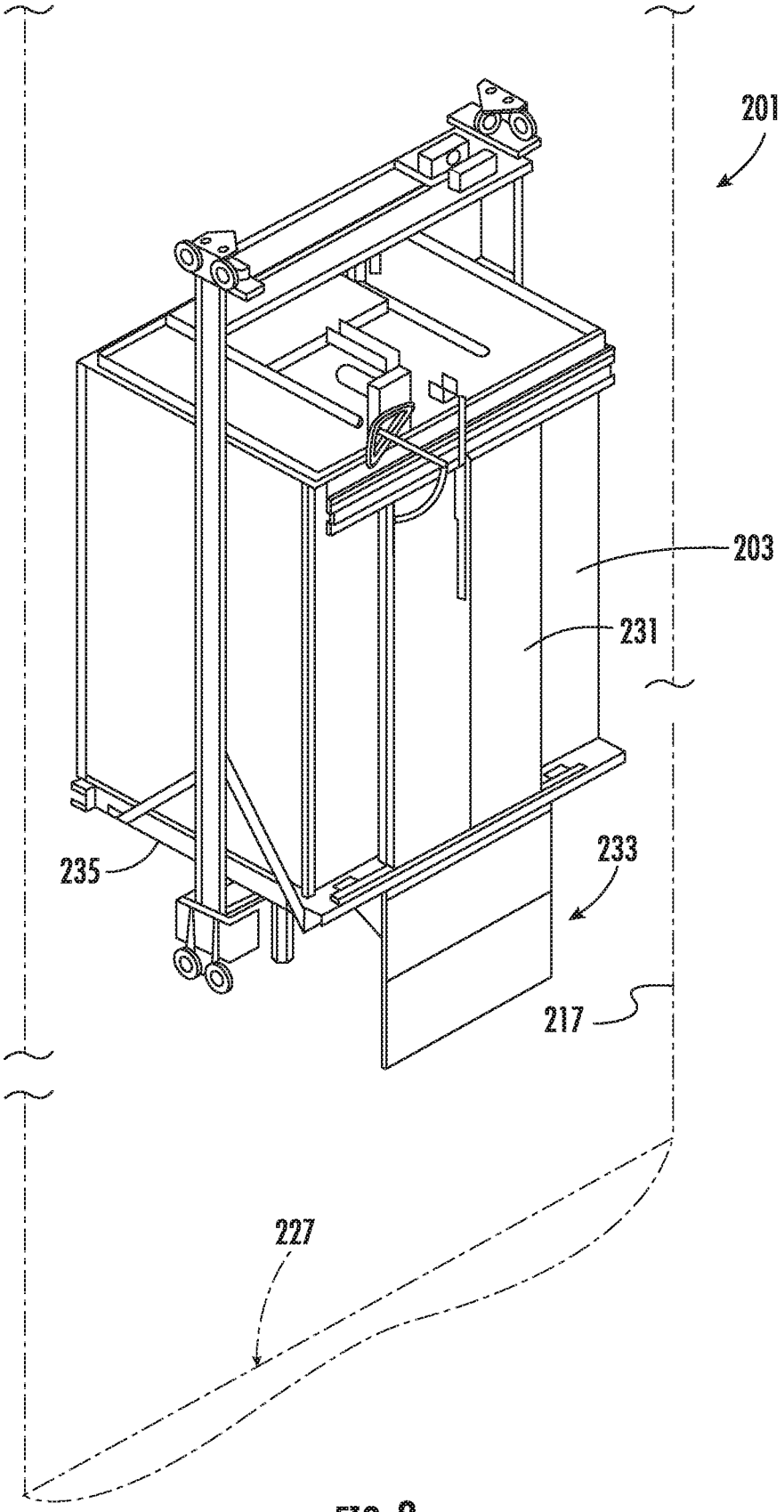
FIG. 2 is a schematic illustration of an elevator system that may employ embodiments of the present disclosure.

FIG. 2 is a schematic illustration of an elevator system 201 that can incorporate embodiments of the present disclosure. The elevator system 201 includes an elevator car 203 that is moveable within an elevator shaft 217. A pit floor 227 is shown at the bottom of the elevator shaft 217. The elevator car 203 includes elevator car doors 231 that open and close to allow ingress/egress to/from the elevator car 203 at one or more landings of the elevator system 201.

A car apron assembly 233 is provided on the elevator car 203 to cover the space between a bottom 235 of the elevator car 203 and an adjacent landing, when the elevator car 203 is in the proximity of the landing. If, for any reason, the landing doors (not shown) were to open before the elevator car 203 is properly aligned with the landing, the car apron assembly 233 is provided to at least partially block the open landing door. One function of the car apron assembly 233 is to prevent people from falling in the elevator shaft 217 during rescue operations when the elevator car door 231 is not aligned with a landing door.

However, the presence of the car apron assembly 233 impacts how close the elevator car 203 can get to the pit floor 227 of the elevator shaft 217. The example car apron assembly 233 of the present embodiment is collapsible or movable between an extended state (shown in FIG. 2) and a retracted state (not shown) that allows the elevator car 203 to descend closer to the pit floor 227 than may otherwise be possible to if the car apron assembly 233 remained in the extended state. That is, the dimensions of the car apron assembly 233 in the retracted state are significantly less than the dimensions of the car apron assembly 233 in an extended state.

Embodiments of the present disclosure are directed to car apron assemblies that are retractable or stowed until use is required. Specifically, low profile aprons are provided that are arranged to automatically deploy only when a rescue or other similar operation is performed. That is, in accordance with embodiments of the present disclosure, the car apron assemblies are arranged to deploy only when an adjacent landing door is operated and opened to gain access to an elevator shaft, when the elevator car is offset from the currently opening landing door. Embodiments described herein employ the use of a part fixed to a landing door panel to actuate a mechanism that will automatically trigger a foldable or retracted car apron in case of dangerous situation. That is, in accordance with embodiments described herein, manual opening of a landing door with an unlocking key and subsequent sliding of the landing door will deploy a car apron assembly to cover or block a vertical gap between a bottom edge of an elevator car and a landing door sill.

In accordance with a non-limiting embodiment, a first triggering element is fixed to a landing door panel and extends into an elevator shaft. When the landing door is opened, and the elevator car is offset from the landing, the first triggering element will contact and actuate a second triggering element that is part of the car apron assembly. Activation or actuation of the second triggering element will cause a car apron to deploy into an extended or deployed state such that a gap between the offset elevator car and the landing will be covered or blocked by the car apron. It is noted that during normal operation, the first triggering element is not aligned with the second triggering element, and thus when the elevator doors open during normal operation, the car apron will not be deployed.

Figure 3A:
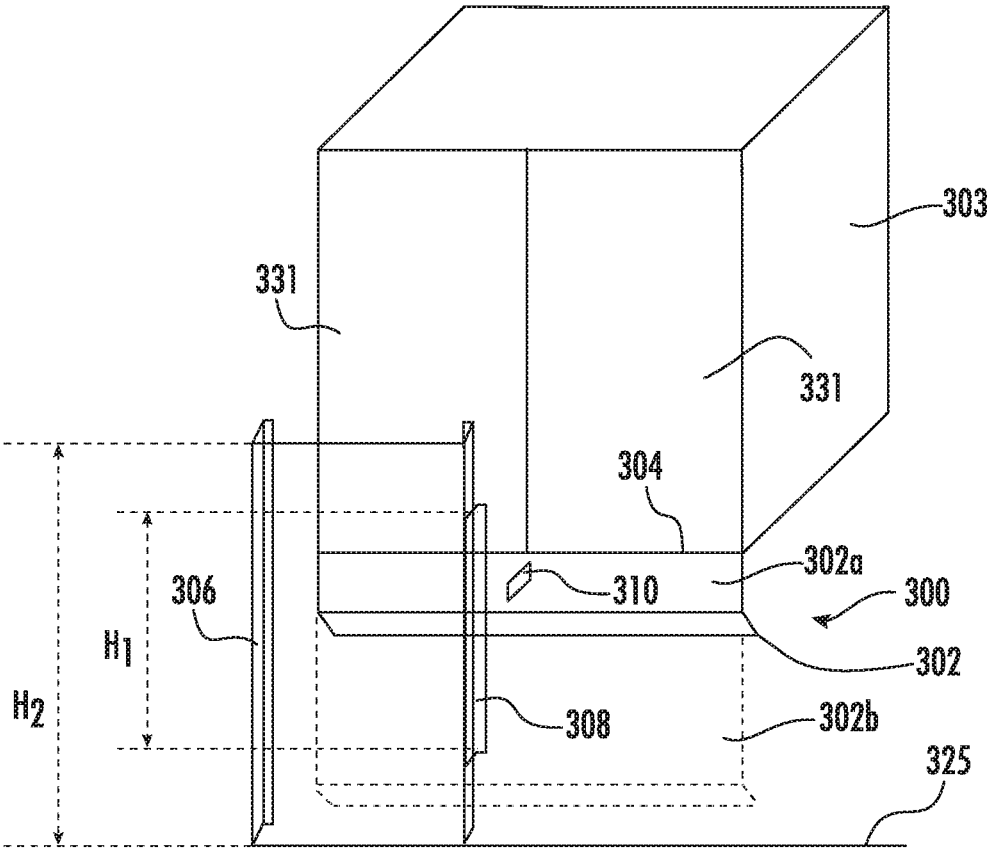
FIG. 3A is an isometric illustration of a car apron assembly in accordance with an embodiment of the present disclosure.
Figure 3B:
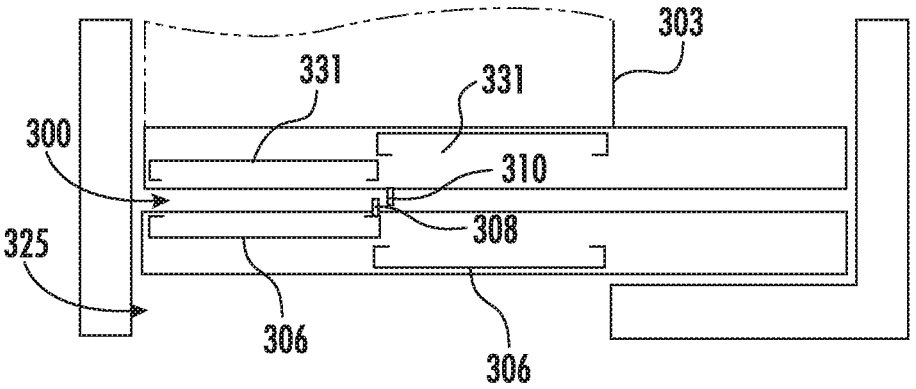
FIG. 3B is a top-down plan view illustration of the car apron assembly of FIG. 3A.

Turning now to FIGS. 3A-3B, schematic illustrations of a car apron assembly 300 in accordance with an embodiment of the present disclosure are shown. FIG. 3A is an isometric illustration of the car apron assembly 300 and FIG. 3B is a top-down plan view of the car apron assembly 300. The car apron assembly 300 is part of an elevator system, such as shown and described above. A retractable car apron 302 is arranged along a car door sill 304 of an elevator car 303. The car apron 302 is arranged to deploy from a stowed state 302*a* to a deployed state 302*b* during an activation operation. The elevator car 303 includes elevator car doors 331 that are openable either automatically (e.g., during normal use) or manually (e.g., during service or rescue operations). FIGS. 3A-3B illustrate the elevator car 303 located at a landing 325, with the landing having landing doors 306 that are openable either automatically (e.g., during normal use) or manually (e.g., during service or rescue operations). Typically, as will be appreciated by those of skill in the art, during normal operation the landing doors 306 and the elevator car doors 331 operate jointly such that opening of the elevator car doors 331 will open the landing doors 306.

As shown, the car apron assembly 300 includes a first triggering element 308 that is fixedly attached to the landing door 306. Further, the car apron assembly 300 includes a second triggering element 310 that is fixedly and operably connected to the car apron 302. The first triggering element 308 that is attached to the landing door 306 is a panel, sheet, or other extension that extends into the elevator shaft a sufficient distance such that a portion of the first triggering element 308 can align with and contact the second triggering element 310 when the elevator car 303 is offset (e.g., slightly above) the landing 325. The first triggering element 308 has a first height $H_1$ and the landing door 306 has a second height $H_2$. The first height $H_1$ of the first triggering element 308 is less than the second height $H_2$ of the landing door 306. Further, the first triggering element 308 does not extend to the bottom of the landing door 306 such that the first triggering element 308 does not interfere with normal operation of the landing door 306 and the elevator car doors 331. However, when the elevator car 303 is offset from the landing 325, as shown in FIG. 3A, the first triggering element 308 will align with the second triggering element 310 to enable engagement therebetween when the landing doors 306 are opened.

The second triggering element 310 is a switch or other operating element or structure that can be actuated when engaged and contacted by the first triggering element 308. That is, as the landing doors 306 are opened, the first triggering element 308 will contact the second triggering element 310 to thus operate the car apron 302 to actuate from the stowed state 302*a* to the deployed state 302*b*. The second triggering element 310 may be a spring-loaded element that after being engaged by the first triggering element 308 and deploying the car apron 302 to the deployed state 302*b*, the second triggering element 310 can be reset automatically. In some embodiments, the retraction of car apron 302 from the deployed state 302*b* to the stowed state 302*a* is manual. In the stowed state 302*a*, the second triggering element 310 secures the car apron 302 in the stowed state 302*a*. That is, once the car apron 302 is fully retracted or stowed, the second triggering element 310 blocks the car apron 302 in up position or stowed state 302*a*. In some embodiments, when the landing doors 306 are closed, the first triggering element 308 can engage with the second triggering element 310 again to reset the second triggering element 310.

Figure 4:
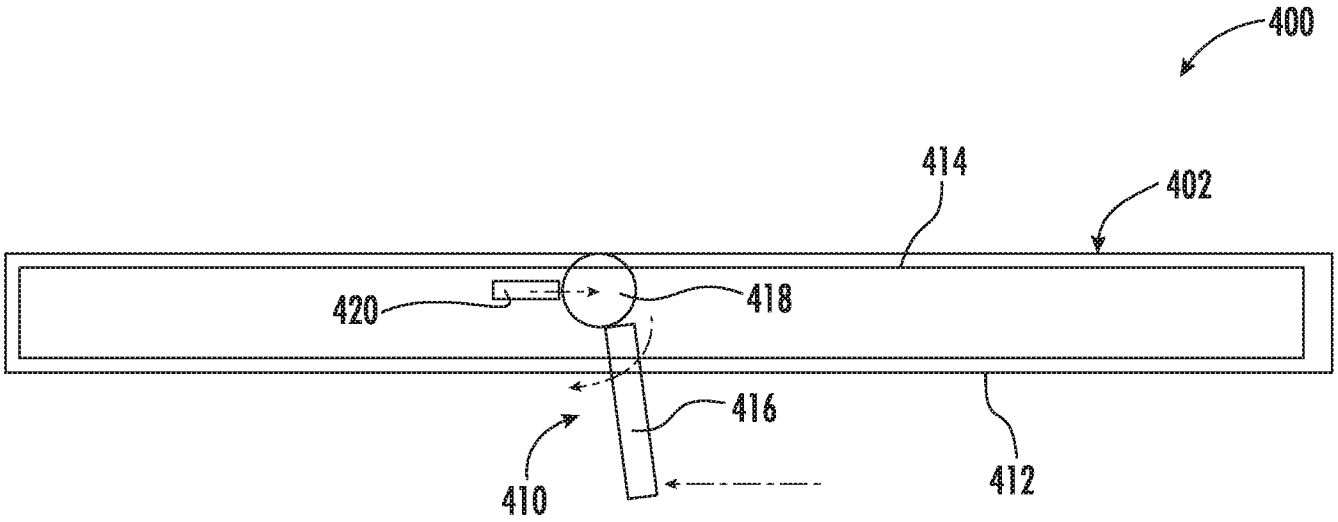
FIG. 4 is a schematic illustration of a portion of a car apron assembly in accordance with the present disclosure.

Turning now to FIG. 4, a schematic illustration of a car apron 402 of a car apron assembly 400 in accordance with an embodiment of the present disclosure is shown. The car apron 402 includes an apron housing 412 with a retractable apron device 414 contained therein. The apron housing 412 is mountable to, fixedly connected to, or part of a car door sill of an elevator car. The retractable apron device 414 is maintained in a stowed state during normal operation of an elevator car, but may be deployed into a deployed state during a maintenance or rescue operation.

A second triggering element 410 is arranged with the car apron 402 and is pivotable or operable to release the retractable apron device 414 from the stowed state to a deployed state. The second triggering element 410 includes an actuation arm 416, a pivot 418, and a lock pin 420. The lock pin 420 is movably engaged with the retractable apron device 414 to secure the retractable apron device 414 in the stowed position. However, when the actuation arm 416 is engaged by a first triggering element that is on a landing door, the actuation arm 416 will rotate about the pivot 418 and cause the lock pin 420 to retract, thus releasing the retractable apron device 414 from the apron housing 412.

Although shown and described in FIG. 4 as a pivot-arrangement, various other types of mechanisms may be employed without departing from the scope of the present disclosure. For example, in some embodiments a slide-track arrangement may be used for securing the retractable apron device in the stowed state until an actuation arm is actuated.

It will be appreciated that every landing of an elevator shaft can include a first triggering element and the elevator car (or cars) that are moveable along the elevator shaft have a second triggering element. Thus, regardless of where the elevator car may stop (e.g., not at or aligned with a landing), an offset landing door that is opened and has a first triggering element may provide safety protection to the opening by actuating the car apron assembly and deploying the elevator car apron.

Advantageously, embodiments described herein provide an automatically deployable car apron. Further, advantageously, car aprons in accordance with the present disclosure may have a stowed state with a minimal profile and thus small elevator pits can be employed. However, when a landing door is opened to gain access to an elevator shaft or elevator car, and the car is offset and adjacent the given landing, the car apron will be automatically deployed during the opening operation of the landing doors. Thus, improved safety may be achieved through the use of car apron assemblies of the present disclosure.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system comprising:

an elevator car movable along an elevator shaft, the shaft having a pit floor and a shaft top, the elevator car having an elevator car door sill;

a plurality of landings arranged along the elevator shaft, wherein each landing has a landing door; and a car apron assembly comprising:

a car apron attached to the elevator car at the elevator car door sill;

a first triggering element connected to at least one landing door and extending into the elevator shaft; and a second triggering element fixedly and operably connected to the car apron and arranged on the elevator car, wherein the second triggering element is aligned with the first triggering element when the elevator car is offset from a landing of the plurality of landings, and during, normal operation of the elevator car, the first triggering element does not align with the second triggering element when the elevator car stops at the landing of the plurality of landings, and wherein the car apron is deployable from a stowed state to a deployed state when the first triggering element engages and actuates the second triggering element.

2. The elevator system of claim 1, wherein the first triggering element does not extend to a bottom of the landing door.

3. The elevator system of claim 2, wherein the car apron comprises an apron housing attached to the elevator car door sill and a retractable apron device contained within the apron housing, wherein the retractable apron device is deployable to a deployed state upon actuation of the second triggering element.

4. The elevator system of claim 1, wherein the car apron comprises an apron housing attached to the elevator car door sill and a retractable apron device contained within the apron housing, wherein the retractable apron device is deployable to a deployed state upon actuation of the second triggering element.

5. The elevator system of claim 1, wherein the second triggering element comprises an actuation arm and a lock pin, wherein the lock pin secures the car apron in the stowed state and actuation of the actuation arm unlocks the lock pin to deploy the car apron to the deployed state.

6. The elevator system of claim 5, further comprising a pivot arranged to operably connect the actuation arm to the lock pin.

7. The elevator system of claim 1, wherein the second triggering element is configured to reset after deployment of the car apron.

8. The elevator system of claim 1, wherein each landing door includes a respective first triggering element.

9. The elevator system of claim 1, wherein the second triggering element is a switch located within the elevator shaft.

10. The elevator system of claim 1, wherein the first triggering element is one of a panel or sheet of material that extends into the elevator shaft.

11. The elevator system of claim 1, wherein the first triggering element has a first height and the landing door has a second height, wherein the first height is less than the second height.

12. The elevator system of claim 11, wherein the first triggering element does not extend to a bottom of the landing door.

13. The elevator system of claim 11, wherein the car apron comprises an apron housing attached to the elevator car door sill and a retractable apron device contained within the apron housing, wherein the retractable apron device is deployable to a deployed state upon actuation of the second triggering element.

14. The elevator system of claim 11, wherein the second triggering element comprises an actuation arm and a lock pin, wherein the lock pin secures the car apron in the stowed state and actuation of the actuation arm unlocks the lock pin to deploy the car apron to the deployed state.

15. The elevator system of claim 14, further comprising a pivot arranged to operably connect the actuation arm to the lock pin.

16. The elevator system of claim 11, wherein the second triggering element is spring loaded configured to reset after deployment of the car apron.

17. The elevator system of claim 11, wherein each landing door includes a respective first triggering element.

* * * * *